US007614932B2

(12) United States Patent
Finarov

(10) Patent No.: US 7,614,932 B2
(45) Date of Patent: Nov. 10, 2009

(54) METHOD AND SYSTEM FOR ENDPOINT DETECTION

(75) Inventor: Moshe Finarov, Rehovot (IL)

(73) Assignee: Nova Measuring Instruments Ltd., Rehovot (IL)

( * ) Notice: Subject to any disclaimer, the term of this patent is extended or adjusted under 35 U.S.C. 154(b) by 0 days.

(21) Appl. No.: 11/726,805

(22) Filed: Mar. 23, 2007

(65) Prior Publication Data

US 2007/0238394 A1 Oct. 11, 2007

Related U.S. Application Data

(63) Continuation of application No. 10/800,611, filed on Mar. 15, 2004, now Pat. No. 7,195,540, which is a continuation of application No. 09/729,441, filed on Dec. 4, 2000, now Pat. No. 6,764,379.

(51) Int. Cl.
*B24B 49/12* (2006.01)

(52) U.S. Cl. ..... 451/6; 451/5; 118/712; 118/723 VE

(58) Field of Classification Search ..... 118/712, 118/715, 723 R, 723 VE, 723 E; 451/6, 5
See application file for complete search history.

(56) References Cited

U.S. PATENT DOCUMENTS

| | | | |
|---|---|---|---|
| 4,618,262 | A | 10/1986 | Maydan |
| 4,977,330 | A | 12/1990 | Batchelder et al. |
| 4,998,021 | A | 3/1991 | Mimasaka |
| 5,032,217 | A | 7/1991 | Tanaka |
| 5,222,329 | A | 6/1993 | Yu |
| 5,240,552 | A | 8/1993 | Yu et al. |
| 5,245,794 | A | 9/1993 | Salugsugan |
| 5,293,216 | A | 3/1994 | Moslehi |
| 5,322,590 | A | 6/1994 | Koshimizu |

(Continued)

FOREIGN PATENT DOCUMENTS

| | | |
|---|---|---|
| EP | 0 444 450 | 9/1991 |

OTHER PUBLICATIONS

Dishon et al., *Dielectric CMP Advanced Process Control Based on Integrated Thickness Monitoring*, VMIC Specialty Conference, Santa Clara, California; Feb. 1997.

(Continued)

*Primary Examiner*—Robert Rose
(74) *Attorney, Agent, or Firm*—Greer, Burns & Crain, Ltd.

(57) ABSTRACT

A method and system are presented for monitoring a process sequentially applied to a stream of substantially identical articles by a processing tool, so as to terminate the operation of the processing tool upon detecting an end-point signal corresponding to a predetermined value of a desired parameter of the article being processed. The article is processed with the processing tool. Upon completing the processing in response to the end-point signal generated by an end-point detector continuously operating during the processing of the article, integrated monitoring is applied to the processed article to measure the value of the desired parameter. The measured value of the desired parameter is analyzed to determine a correction value thereof to be used for adjusting the end-point signal corresponding to the predetermined value of the desired parameter for terminating the processing of the next article in the stream.

10 Claims, 3 Drawing Sheets

U.S. PATENT DOCUMENTS

| | | | | |
|---|---|---|---|---|
| 5,433,651 | A | | 7/1995 | Lustig |
| 5,609,511 | A | | 3/1997 | Moriyama et al. |
| 5,658,183 | A | | 8/1997 | Sandhu |
| 5,659,492 | A | | 8/1997 | Li et al. |
| 5,664,987 | A | | 9/1997 | Renteln |
| 5,730,642 | A | | 3/1998 | Sandhu |
| 5,851,135 | A | | 12/1998 | Sandhu et al. |
| 5,872,633 | A | | 2/1999 | Holzapfel et al. |
| 5,910,011 | A | | 6/1999 | Cruse |
| 5,964,643 | A | | 10/1999 | Birang |
| 5,964,980 | A | * | 10/1999 | Robinett ..... 156/345.25 |
| 6,106,662 | A | | 8/2000 | Bibby, Jr. et al. |
| 6,276,987 | B1 | | 8/2001 | Li et al. |

OTHER PUBLICATIONS

Lützen et al., *Oxide Chemical Mechanical Polishing Closed Loop Time Control*, SPIE, vol. 3882, Santa Clara, Sep. 22-23, 1999.

* cited by examiner

METHOD AND SYSTEM FOR ENDPOINT DETECTION

This application is a Continuation of U.S. patent application Ser. No. 10/800,611 filed Mar. 15, 2004 now U.S. Pat. No. 7,195,540, which is a Continuation of U.S. patent application Ser. No. 09/729,441 filed Dec. 4, 2000, now U.S. Pat. No. 6,764,379.

FIELD OF THE INVENTION

This invention is generally in the field of controlling the process of semiconductor manufacture, and relates to an apparatus and method for in-situ endpoint detection during various processes applied to semiconductor wafers, such as Chemical-Mechanical-Polishing (CMP), Chemical Vapor Deposition (CVD), etching, photolithography, and others.

BACKGROUND OF THE INVENTION

The manufacture of semiconductor articles, such as wafers, consists of forming various materials layers and structures of certain different thicknesses. Usually, this process includes deposition and removal of different materials using such techniques as CMP, CVD, etching, photolithography, etc. An important step in these procedures is terminating the process after the desired thickness is reached. For example, when dealing with CMP or etching, this process should be terminated after the layer being etched or polished is removed (e.g., partly removed such that a required remaining thickness of this layer is reached), or before the next, underlying layer is removed. A technique of determination of that process point at which the processing should be stopped is called "endpoint detection".

The term "processing" used herein signifies at least one of the following: removing an uppermost layer or depositing a layer of a different material onto the wafer's surface. An endpoint detector serves to determine whether the desired thickness of the layer being removed or deposited is reached, aimed at terminating the removing or deposition process. In most cases, the process is terminated in response to a predetermined signal generated by such an end-point detector (or a plurality of such detectors).

CMP is a known process aimed at the planarization of the surface of the uppermost wafer's layer. CMP is basically a mechanical polishing of the wafer's surface using a pad pressed against the wafer, rotating one with respect to the other, all in a chemical liquid environment, which enhances the polishing. Like any semiconductor process step, tight control of the CMP process is required to maintain high yield levels. The polishing removal rate, which is the main process characteristic, is a complex function of different parameters which are partly controlled or understood. These dependencies, when combined with requirements for high uniformity levels and tight process reproducibility and control, dictate intensive thickness measurement procedures, notably in oxide polishing that has no natural end-point. As a result, monitoring systems and methods are a crucial part of the CMP process.

Chemical Vapor Deposition (CVD) and etching are two other major sub-processes in the semiconductor production. The former is aimed at depositing thin films (e.g., oxides, metals) on a semiconductor wafer, whereas the latter is aimed at patterning thin films according to a developed three-dimensional image on the films. In a similar manner to CMP, both CVD and etching are influenced by various parameters, and should therefore be tightly monitored and controlled in order to achieve the set targets of the process. As for the photolithography technique, similar processes, namely, photoresist coating (e.g., by spinning) and photoresist development (i.e., selective removing by etching) take place during the photoresist processing step.

The following are three major techniques used for controlling one of the above processes of semiconductor manufacture, discussed with respect to CMP:

(1) Stand Alone (SA) Systems.

An SA system is installed outside the production line ('off-line') and wafers to be measured by this system are supplied thereto from the production line after the wafer processing is completed. The known SA systems for CMP are OptiProbe 2500, commercially available from ThermaWave, USA, and UV1250, commercially available from KLA-Tencor, USA. SA systems have excellent capability to provide full and accurate information concerning the measurement parameters. However, SA systems suffer from several drawbacks such as a lag in response time, large foot-printing, and clean room and additional handling of wafers issues.

(2) In-Situ Detectors

These are various sensors (optical, electrical, mechanical, etc.) which are installed in the working area ('in-situ') of the processing tool (e.g., the area between the wafer and the rotating pad of the polisher), are capable of real-time detecting the process end-point (e.g., motor current), and of continuously detecting the product parameters (e.g., thickness) and both product and process parameters (e.g., removal rate). Such an in-situ end-point detector (EPD) to be used with CMP equipment is disclosed, for example, in U.S. Pat. No. 5,433,651. The end-point detector comprises a window, which enables in-situ viewing of the polishing surface of the workpiece from an underside of the polishing table during polishing. Reflectance measurement means are coupled to the window on the underside of the polishing table. A prescribed change in the in-situ reflectance corresponds to a prescribed condition of the polishing process.

An EPD reduces the time required to qualify a process, and shortens conditioning time whenever pads are replaced. EPDs are mainly used in processes such as plasma etching. The known EPD tools for CMP are models 2350/2450 Endpoint Controllers, commercially available from Luxtron, Santa Clara, USA, and ISRM, commercially available from Applied Materials, Santa Clara, USA.

Unfortunately, EPD suffers from the following drawbacks: When applying the CMP to dielectric layers (which is a so-called "blind stop" process), additional frequent post-polish measurements on SA systems are needed. This is associated in the following. The EPD sensor is located in the interior of the processing area, and measures average data over a relatively large area comprising different and variable patterns. As a result, it cannot provide information concerning local planarization, and is therefore less informative as compared to an SA tool. The average data generated by the EPD does not allow for mapping the wafer's plan, whereas the latter may be of high importance. Additionally, the interpretation of in-situ sensor data is complex and less accurate, since it is also affected by irregular environment characteristics such as electrical noise, slurry, mechanical movement, etc. The in-situ EPD has low accuracy due to low optical resolution and strong signal dependency on wafer's pattern.

To demonstrate problems arising from the detection of the layer's end of polish with an in-situ EPD, reference is made to FIGS. 1 and 2. FIG. 1 illustrates a common structure, generally designated 1, of stack layers on a semiconductor wafer W, which structure is to be polished. The structure 1 contains a silicon substrate 2, a Silicon Nitrate layer ($Si_3N_4$) 4, and a top Silicon Oxide layer ($SiO_2$) 6. FIG. 2 illustrates possible signal time changes determined by an EPD sensor during the CMP process applied to the two upper layers 4 and 6. In this example, the part A presenting a substantially "flat" graph indicative of slow signal variations corresponds to the signal detected from the upper Silicon Oxide layer 6 being polished. When the layer 6 is almost completely removed, a varying signal (part B) is detected, which changes faster with the layer's disappearance. At last, when the Silicon Nitrate layer 4 is being polished, a substantially slow changing signal is observed (part C). The signal boundaries between the parts A and B, and B and C are not sharp and clear. Hence, simple threshold-based signal analysis may cause failures, either because of "early detection" (the layer to be polished is not sufficiently removed) or because of "late detection" which means that the undesirable removal of the lower layer has started.

The main difficulty in obtaining high accuracy in optical EPD is signal dependency on wafer pattern, since EPD spot size includes a lot of features with different layers structure. The effect may be stronger than signal change during polishing. There is a great variety of approaches aimed at increasing the accuracy of the endpoint detection. U.S. Pat. No. 5,910,001 discloses a method and apparatus for in-situ monitoring, using multiple process parameters. This technique utilizes analyses of the multiple process parameters and statistical correlation of these parameters to detect changes in process characteristics, such that the endpoint of the etching process may be accurately detected. Another improved endpoint technique is disclosed in U.S. Pat. No. 5,964,980. Here, a fitted endpoint system provides normalizing the current endpoint curve generated from the series of multi-bit digital code words for a wafer being etched with respect to the standard endpoint curve and providing a normalized current endpoint curve.

However, none of the known EPDs provides required measurement performance, equal or similar to SA measurement tools.

(3) Integrated Monitoring (IM) Technique

An integrated monitoring tool (IMT) is installed inside or attached to the process equipment (PE), at a location where a wafer can be monitored immediately after completion of the process, while still within the internal environment of the PE (i.e., 'in-line' monitoring). Wafers are supplied to the IMT by the PE's robot. IMT can be used for a CMP (e.g., integrated thickness monitoring (ITM) tool such as ITM NovaScan 210, commercially available from Nova Measuring Instruments Ltd., Israel), etching and CVD processes. The IMT combines the performance of a SA tool with short time-to-respond of usually one wafer delay only, i.e., not much longer than the real-time response of an EPD. Consequently, an IMT has advantages over SA tool and provides additional important information, as compared to the EPD system, with practically no performance loss. These advantages are emphasized with respect to the ITM apparatus:

The ITM measurement unit provides thickness measurement data for every product wafer, hence, enabling fast feedback or feed-forward control of the CMP. Measurements are carried out in parallel to processing the next wafer(s), thus, there is no affect on PE throughput.

Some known techniques utilizing the principles of ITM for closed-loop control are disclosed in the following articles: "*Dielectric CMP Advanced Process Control Based on Integrated Thickness Monitoring*", VMIC Speciality Conference, Santa Clara, 1997; and "*Oxide Chemical mechanical Polishing Closed Loop Time Control*", CPIE, Vol. 3882, Santa Clara, 1999.

Although such problems as the wafer handling, clean room space and labor needed for SA tools operations are completely eliminated in the ITM, the latter still does not give a real-time response, but rather a post-factum measurement of the CMP process, and cannot eliminate the problem of different thicknesses of the processed layer that might happen during processing of at least one wafer.

U.S. Pat. Nos. 5,658,183 and 5,730,642 disclose a specific system for polishing a semiconductor wafer, wherein the ITM tool (NovaScan 210) and an in-situ detector are used. The in-situ detector is aimed at controlling various process parameters, while the end-point detection aimed at determining whether the polishing of the wafer is complete is performed by interrupting the polishing process and performing repetitive measurements with the ITM tool. It is evident that this technique does not provide real-time endpoint detection.

SUMMARY OF THE INVENTION

There is accordingly a need in the art to improve the control of various semiconductor-manufacturing processes by providing a novel apparatus and method capable of accurately and efficiently detecting the process end-point.

It is a major feature of the present invention to provide such a method and apparatus that combine the benefits of both EPD and IT techniques to be used in CMP, CVD, etching and other processes.

The main idea of the present invention consists of applying both EPD and IT to an article (e.g., semiconductor wafer) under processing and analyzing signals generated by them to detect accurately the end-point of the article processing. For analysis purposes, an apparatus according to the invention utilizes a data processing unit, which determines relevant process parameters for a specific processing tool configuration and the parameters of the wafer being processed by this tool, to make a decision (signal) indicative of the completion of the processing of this specific wafer. Different types of EPD could be used, which may depend on the specific process, e.g., optical, electrical, mechanical, etc. detectors.

The present invention can be used with any type of integrated tool. As indicated above, the term "integrated tool" (IT) signifies an apparatus, which is physically installed inside a processing tool arrangement or attached thereto, so as to be outside the working area defined by the processing tool, and which enables the measurement performance to meet the requirements of accuracy and repeatability over the whole wafer surface. The IT is usually designed in accordance with the construction and operation of a specific processing tool, and articles (wafers) are preferably transferred to the IT (for e.g., monitoring, metrology, inspection, etc.) by the same robot, used in the processing tool.

There is thus provided, according to one aspect of the present invention, a method for monitoring a process sequentially applied to a stream of substantially identical articles by a processing tool, so as to terminate the operation of the processing tool upon detecting an end-point signal corresponding to a predetermined value of a desired parameter of the article being processed, the method comprising the steps of:

(i) processing the article with said processing tool;

(ii) upon completing the processing of said article in step (i) in response to the end-point signal generated by an end-point detector continuously operating during the processing of said article, applying integrated monitoring to the processed article for measuring the value of said desired parameter;

(iii) analyzing the measured value of the desired parameter, and determining a correction value to be used for adjusting said end-point signal corresponding to the predetermined value of the desired parameter for terminating the processing of the next article in the stream.

In step (ii), the end-point signal may be set during the processing of a first article in the stream of articles. The end-point signal may be a predetermined spectrum of light returned from the article. The desired parameter may be a thickness of at least an uppermost layer of the article, in which case the integrated monitoring is capable of thickness measurements.

Preferably, the determination of the correction value comprises the following steps:

determining the difference between said predetermined value of the desired parameter and said measured value;

determining the ratio of said difference to the processing rate, to determine a time period on which the time processing of the article should be changed to obtain said predetermined value of the desired parameter;

determining the value of the end-point signal corresponding to the changed processing time to be used for correcting the end-point signal for processing the next article.

The difference between the predetermined value of the desired parameter and the measured value may be determined for at least two articles, and either an average difference value or an accumulated difference value be used for determining the ratio.

The processing may be CMP, CVD, etching, photolithography, etc., using a corresponding processing tool. The stream of articles may be semiconductor wafers progressing on a production line.

According to another aspect of the present invention, there is provided an end-point detection system for use with a processing tool which is to be sequentially applied to a stream of substantially identical articles, the system comprising:

(1) an end-point detector accommodated within a working area defined by the processing tool when applied to the article;

(2) an integrated monitoring tool accommodated within said processing tool outside said working area and capable of measuring a desired parameter of the article; and (3) a control unit associated with the end-point detector and with the integrated monitoring tool, the control unit being responsive to data coming from the end-point signal for terminating the processing of the article, and to the measured data coming from the integrated monitoring tool, so as to analyze these data and determining a correction value to be applied to the end-point signal corresponding to a predetermined value of said desired parameter of the article achieved by the processing thereof.

Preferably, the end-point detector utilizes optical means. The integrated monitoring tool may be of a kind capable of spectrophotometric measurements. The control unit may be a common device coupled to the end-point detector and to the integrated monitoring tool, or composed of several separate devices, for example, one being associated with the end-point detector and the integrated monitoring tool, and the other being a constructional part of the processing tool.

According to yet another aspects of the present invention, there are provided a novel CMP tool arrangement, CVD tool arrangement, etching tool arrangement, and photolithography tools arrangement

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

The features of the present invention are described below with respect to CMP process applied to semiconductor wafers.

Figure 1:
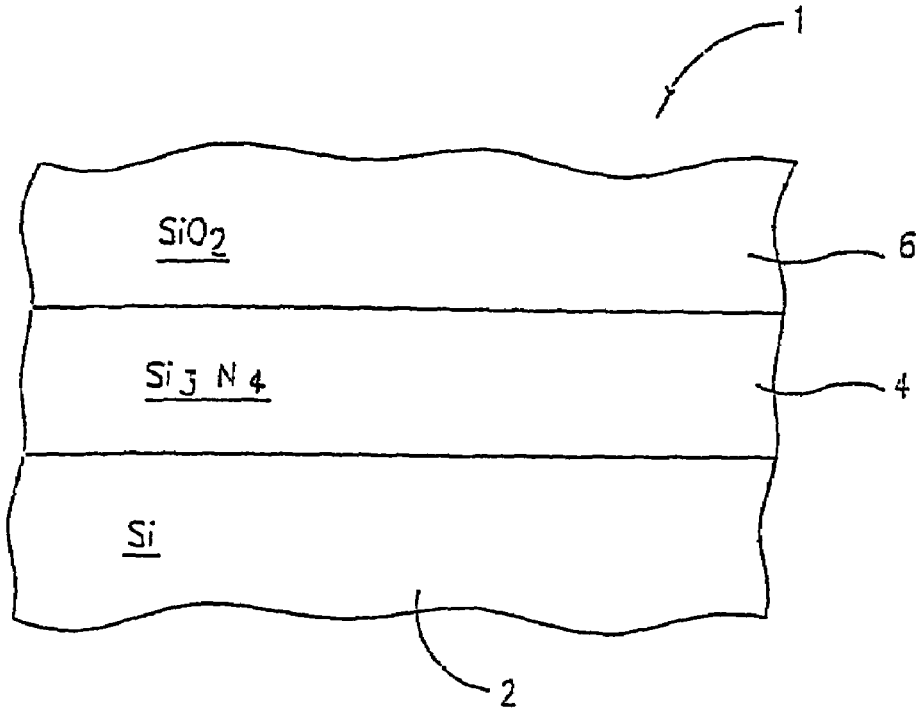
FIG. 1 illustrates a common stack layer structure of a semiconductor wafer to be processed by CMP.
Figure 2:
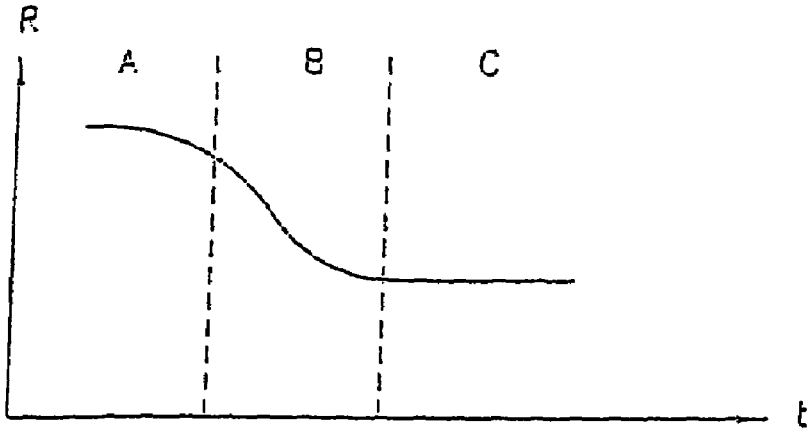
FIG. 2 graphically illustrates signal characteristics determined by an EPD sensor during a CMP process of structure of FIG. 1 in a conventional manner.
Figure 3:
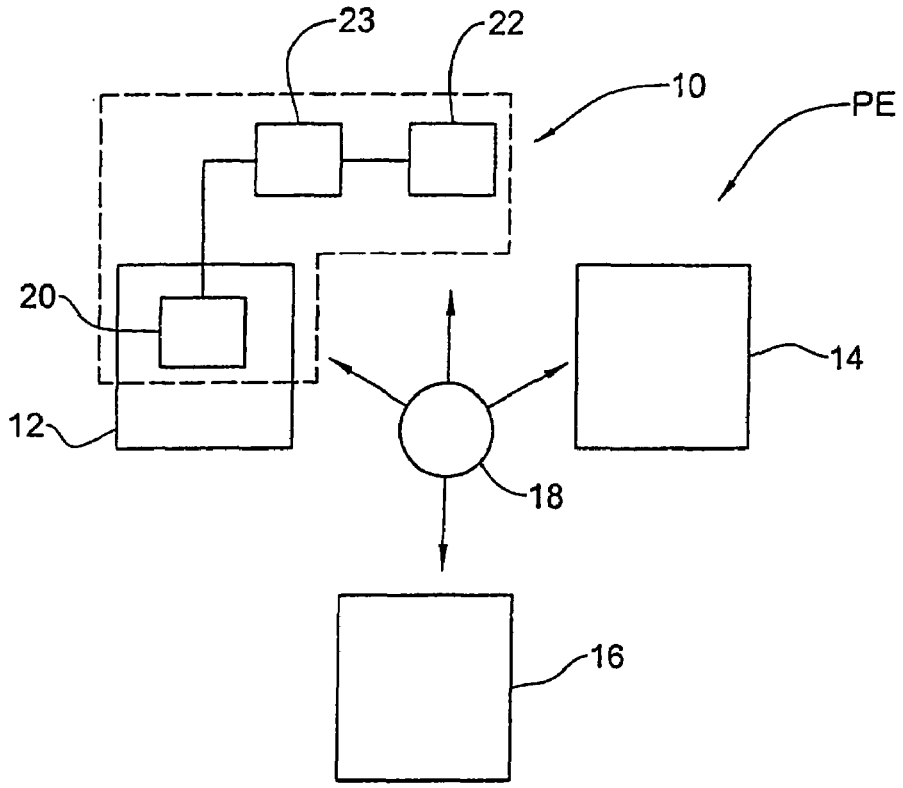
FIG. 3 schematically illustrates a polishing tool arrangement with an end-point detection system according to the present invention utilizing EPD and IT.

Referring to FIG. 3, the main components of a polishing tool arrangement PE are schematically illustrated, utilizing an end-point detection system 10 according to the invention. The polishing tool arrangement PE is typically composed of such main constructional parts as a polisher 12, a cleaner 14, wafers, a load/unload cassette station 16 and a robot 18 that transfers wafers between these parts. The system 10 is a combination of an EPD 20 and an Integrated Tool (IT) 22, both coupled to a control unit (CU) 23. The EPD 20 is installed within the active polishing area (working area), e.g., the contact area between the wafer under polishing and the polisher's pads (which are not specifically shown). As for the IT 22, it is accommodated adjacent to the polisher 12. It should, however, be noted although not specifically shown, that the IT 22 could be installed inside the polisher, provided it is located outside the active polishing area.

Figure 4:
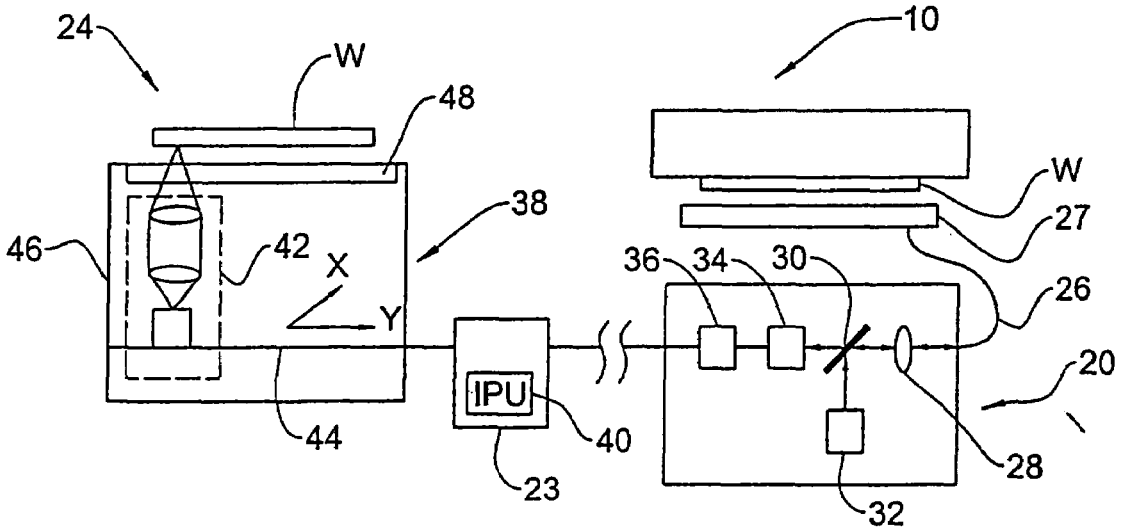
FIG. 4 more specifically illustrates a system according to the invention utilizing an ITM system as the IT.

FIG. 4 illustrates one possible configuration of the end-point detection system 10, utilizing an ITM tool whose measurement unit (MU) 24 is used as the integrated tool. Thus, the system 10 comprises the EPD sensor 20, MU 24, and control unit 23.

The control unit 23 is typically a computer device that comprises a central processing unit and also image and signal acquisition means. Generally speaking, the control unit 23 includes suitable hardware and is operated by suitable software for acquiring images of the wafer undergoing polishing, as well as measured signals (corresponding to measured parameter(s)), and analyzing data indicative thereof. The control unit thus contains signal processing and computational intelligence for calculating desired parameters (e.g., thickness) and for decision making (i.e., for terminating the polishing when needed). In other words, the control unit is responsive to data coming from the EPD and ITM for generating a decision-indicative signal. It should be understood that the CU 23 can be replaced by several control units (e.g., one associated with the ITM and the other with the processing tool), which are connectable to each other by any known suitable communication means (i.e., communication line and protocol).

In the present example, the EPD 20 is of an optical type, composed of an optic fiber 26, a lens 28, a beam splitter 30, a light source 32, an optical sensor, e.g. spectrophotometer 34, and a data input-output port 36. The optical fiber 26 is coupled to the inside of the polisher's pad 27, so as to enable the direct connection between the fiber entrance and the wafer's plan $W_2$. The light source 32 can be a broad-band or narrow-band light source or a laser. Light generated by the light source 32 is deflected by the beam splitter 30 and lens 28, conveyed through the optical fiber 26, to reach the wafer's plan $W_2$, and is reflected back in the same way towards the sensor 34, where the reflected signal is detected. The detected signal is transferred to the control unit 23 (via the port 36) for further processing. In some cases such as CVD, where the direct optical access to the wafer is possible, the light beam travels towards and away from the wafer directly, without the use of any light guide (optical fiber 26). It should also be noted that the case may be such that incident light is directed to the measured wafer from its back side (through an appropriate path in a supporting "cap").

It should be understood that any other known suitable EPD could be used in the present invention. It may utilize various sensors, such as optical sensors, polisher motor current based sensors, chemical and/or temperature sensors, etc.

The ITM tool 24 can be any integrated thickness monitor, such as the metrology tool ITM NovaScan 210, commercially available from Nova Measuring Instruments Ltd., Israel. In general, the ITM tool 24 comprises a measurement unit 38 coupled to the common control unit 23, which controls the operation of the unit 38. It should be noted that a separate control unit may be used interconnected between the measurement unit 38 and the control unit 23.

The measurement unit 38 comprises an optical assembly 42, associated with a translation system 44, such as the X-Y stage. The optical assembly 42 is accommodated in a sealed housing 46 formed with a transparent optical window 48. The main two functions of the measurement unit 38 operated by the control unit 23 are as follows: the positioning of the optical assembly with respect to the wafer, and the thickness measuring. The positioning is aimed at identifying, through the optical window 48, the exact location and orientation of a wafer $W_1$, and location of a measurement site on the wafer $W_1$ to be measured. This step is usually carried out using the wafer's pattern through the channel of image accusation and processing (recognition). The wafers $W_1$ and $W_2$ are identified as two sequentially processed wafers in the lot, each wafer being first processed by the polisher and then measured by the ITM. It should be understood that, in the present example, $W_1$ is the wafer that has already been processed and is undergoing measurements, and wafer $W_2$ is that undergoing processing.

Such a construction of the measurement unit, namely which provides the translation of the optical assembly with respect to the wafer, permits its integration within the wafer processing tool or cluster, such as polisher, CVD chamber, etc. and provides thickness measurements immediately after completing the wafer processing. The window 48, together with the sealed housing 46, provides wafer thickness measurements in a medium similar (or the same) to the processing environment. For example, in the case of CMP, such a medium is water, and in the case of CVD or etching, it is a vacuum. Data generated by the ITM (measured parameters and acquired images) are processed by data and image-processing unit 40, being part of the control unit 23.

The system 10 operates in the following manner. Usually, when dealing with the "first coming" wafer in the lot, the processing time (i.e., polishing time in the present example) is calculated using information regarding the initial and target (desired) thicknesses, polished layer(s) material(s) and polishing parameters, e.g., polishing rate. This first wafer processing time could be set according to that of a similar wafer. Alternatively, a predetermined signal value of EPD corresponding to the desired thickness of the polishing layer could be set up using information on stack layers structure, etc. This information is entered and stored in the memory of the control unit 23, or in a central computer of the processing tool, i.e. a polisher, as the case may be.

The first wafer of the lot (the lot usually containing 25 wafers) is transferred from the load cassette 16 to the polisher 12 by the robot 18, and the CMP process is initiated. During polishing, EPD 20 performs measurements of reflected signal spectrums and generates data indicative thereof, which are transferred to the control unit 23 for storing and further processing.

As noted above, the polishing process could be terminated upon detecting the pre-determined signal generated by the EPD 20 at a specific frequency or frequency range. The specific shape of the end-point corresponding spectrum could also be used for decision criteria for terminating the processing. This data is stored in the control unit 23, prior to starting the polishing process.

After completing the polishing process in accordance with the predetermined threshold criteria (e.g., polishing time, signal value within a predetermined frequency range, spectrum shape, etc.), the processed wafer is transferred to the ITM tool 22 (by robot 18), and positioned above the transparent window 48. The wafer W could be held above the window 48 by a vacuum holder (not shown), or by any other suitable mechanism. The optical assembly 42 performs thickness measurements on multiple desired sites of the wafer W (by moving the optical assembly with respect to the wafer). The thickness measurement procedure performed by ITM is known per se and therefore need not be specifically described.

After the measurement procedure is complete, the measured data is transmitted to the control unit 23. The latter processes the so-obtained data for correcting the end-point signal value or any other characteristic corresponding to the desired target parameter of the processing (thickness of the top layer in this specific example). For example, if the thickness value measured by ITM tool 22 is less than the target thickness, this means that the wafer is "over-polished", and the appropriate correction of the end-point signal value should be made, for example, by applying a known interpolation procedure to the time function of the end-point detector signal. When the measured thickness is higher than the target one, this means that the wafer W is "under-polished", and consequently the polishing time of the next coming wafer in the lot should be increased. In this case, the appropriate value of the end-point detection signal could be defined by the extrapolation procedure.

Such interpolation and extrapolation correction procedures could, for example, be based on the information regarding the processing rate obtained from the EPD signal. For example, the value of the end-point signal corresponding to the desired target thickness may be obtained by calculating the end-point vs. time function in accordance with the following scheme:

a) the difference, $\Delta T$, between the target thickness and that measured by the ITM tool presenting the process error is calculated;

b) the so-called "time adjusting factor", $\Delta t$, is calculated as the ratio of the thickness difference, $\Delta T$, to the processing rate PR (i.e., the polishing rate in this specific case), based on which the polishing time should be prolonged or shortened;

c) adjusting the end-point "threshold" by determining the end-point signal value corresponding to the prolonged/shortened polishing time.

The same procedure is repeated for each next coming wafer.

The techniques disclosed in the above-indicated articles can also be applied for adjusting the end-point "threshold" value. According to some of these techniques, different proportional gains could be applied so as to take into consideration different process parameters and/or properties of the wafer to be processed. More sophisticated statistical techniques, using the so-called "integral part", including the accumulated or averaged error for number of wafers, could be applied. An average processing (removal) rate for number of processing cycles also could be considered.

Generally speaking, the EPD signal is calibrated or adjusted using the data obtained from the ITM tool having much more powerful metrology capabilities to detect accurately the end-point of the wafer processing.

In accordance with another preferred embodiment, for timely terminating the processing of the first wafer in the lot, a calibration curve of the end-point signal versus thickness could be obtained. To this end, values of the top layer thicknesses are measured by the ITM tool 22 during the polishing process. This is implemented by periodically terminating the process and supplying the wafer to the ITM tool 22 for measurement. Concurrently, the end-point signals generated by the EPD 20 are registered. By this, the calibration curve could be plotted with the desired resolution. Further processing of the next wafer is performed in accordance with the above-described scheme.

In accordance with yet another preferred embodiment, pre-process thickness measurements are performed. This technique is preferred in such cases, where the end-point detectors of a kind providing cyclic signals are used. Such a cyclic signal is usually generated by an EPD based on interference measurements, and is disclosed for example in U.S. Pat. No. 5,964,643. In this case, the end-point signal cyclically varies with the thickness of the layer being polished, as it is reduced during the CMP process. The CMP process in this case is terminated when a predetermined number of peaks (signal maximums) is obtained. Information regarding the layer thickness obtained before the polishing starts permits definition of this predetermined number of peaks corresponding to the desired thickness. Further adjusting of the threshold within the selected peak is performed in accordance with the above-described scheme.

It should be noted that several different or identical EPDs can be used in the same processing tool arrangement (polisher), and operated in combination with the single ITM tool, all coupled to the common control unit.

The process monitoring and control continue from wafer to wafer or from wafer to lot, or any other desired combination. In this manner, a closed loop control (CLC) over the entire CMP process can be established.

Figure 5:
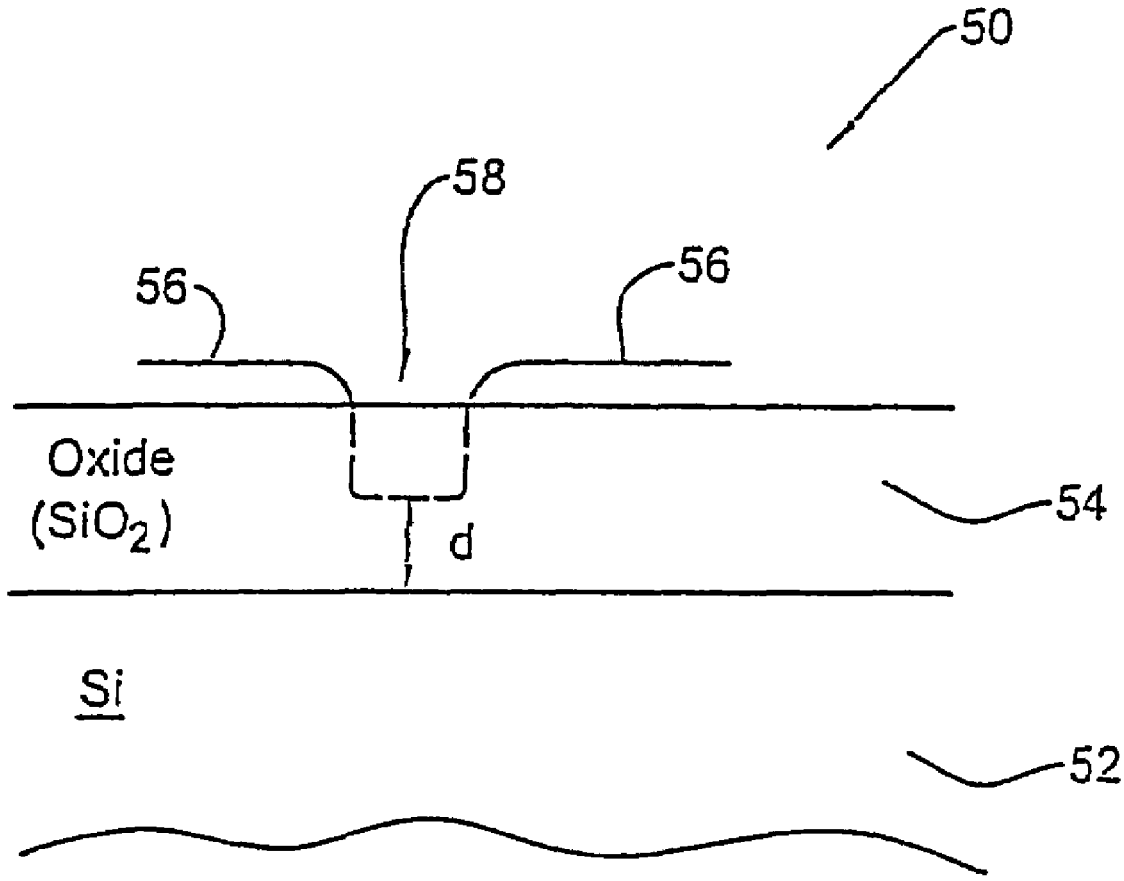
FIG. 5 schematically illustrates a stack layer structure of a semiconductor wafer, to which the present invention can be applied.

The end-point detection system according to the invention (i.e., a combination of EPD and IM) can be used for etching or CVD processes as well. FIG. 5 illustrates a common stack layer structure 50 to which the etching process is typically applied. The structure 50 comprises a silicon substrate 52, an oxide layer (e.g., $SiO_2$) 54, and patterned photoresist layer 56. During the etching process (e.g., in the case of dual Damascene process) a region 58 is to be etched in the oxide layer. When etching is completed, the oxide layer 54 having the thickness d remains in the region 58. The end-point detection can utilize any known EPD device, for example, that disclosed in U.S. Pat. No. 4,618,262.

It should be emphasized that, in many cases, a combination of the EPD and the ITM in the same processing equipment provides the unique capability of calibrating the EPD by help of the ITM, practically in real time (with a delay of only one wafer between the ITM measurement and the next wafer undergoing processing), thereby providing ultimate process control. The high metrology performance of the ITM systems allows to calibrate the EPD according to different criteria, namely absolute remaining thickness of the removed layer, the thickness of the removed layer, removal rate, etc. High metrology performance of the ITM systems is based on the fact that data are received from different points on the wafer representing the so-called "Within the Wafer's Uniformity", additionally to the so-called "Wafer-to-Wafer Uniformity". Thus, the advantages of both methods, i.e., real time response of the EPD and high metrology performance of the ITM, are combined in one powerful process control system.

Those skilled in the art will readily appreciate that various modifications and changes can be applied to the preferred embodiment of the invention as hereinbefore exemplified without departing from its scope, defined in and by the appended claims.

The invention claimed is:

1. An end-point detection system for use with a material deposition processing tool which is to be sequentially applied to a stream of substantially identical articles, the system comprising:

(a) an end-point detector accommodated within a working area defined by the material deposition processing tool when applied to the article;

(b) an integrated monitoring tool accommodated within the material deposition processing tool outside said working area and capable of measuring a thickness of the article; and (b) a control unit associated with the end-point detector and with the integrated monitoring tool, the control unit being in-line operative to be responsive to data coming from the end-point signal for terminating the processing of the article, and to be responsive to the measured data coming from the integrated monitoring tool, so as to analyze these data and determine a correction value to be applied to the end-point signal corresponding to a predetermined value of the thickness of the article achieved by the processing thereof.

2. The system according to claim 1, wherein said end-point detector utilizes optical means.

3. The system according to claim 1, wherein said stream of the articles includes semiconductor wafers.

4. The system according to claim 1, wherein said integrated monitoring tool is capable of spectrophotometric measurements.

5. The system according to claim 1, wherein said processing is CVD.

6. A material deposition tool arrangement comprising a processing, to be sequentially applied to a stream of articles, and an end-point detection system, said end-point detection system comprising:

(a) an end-point detector accommodated within a working area defined by the processing when applied to the article;

(b) an integrated monitoring tool accommodated within said processing tool outside said working area and capable of applying in-line measurements of a thickness of the article under the material deposition; and (c) a control unit associated with the end-point detector and with the integrated monitoring tool, the control unit being responsive to data coming from the end-point signal for terminating the material deposition on the article, and to the measured data coming from the integrated monitoring tool, so as to analyze these data and determine a correction value to be applied to the end-point signal corresponding to a predetermined value of the thickness of the article achieved by the processing thereof.

7. An end-point detection system for use with a CVD processing tool which is to be sequentially applied to a stream of substantially identical articles, the system comprising:

(a) an end-point detector accommodated within a working area defined by the CVD processing tool when applied to the article;

(b) an integrated monitoring tool accommodated within the CVD processing tool outside said working area and capable of measuring a thickness of the article; and (b) a control unit associated with the end-point detector and with the integrated monitoring tool, the control unit being in-line operative to be responsive to data coming from the end-point signal for terminating the processing of the article, and to be responsive to the measured data coming from the integrated monitoring tool, so as to analyze these data and determine a correction value to be applied to the end-point signal corresponding to a predetermined value of the thickness of the article achieved by the processing thereof.

8. The system according to claim 7, wherein said end-point detector utilizes optical means.

9. The system according to claim 7, wherein said stream of the articles includes semiconductor wafers.

10. The system according to claim 7, wherein said integrated monitoring tool is capable of spectrophotometric measurements.

* * * * *